US006502663B2

(12) United States Patent
Ecker et al.

(10) Patent No.: US 6,502,663 B2
(45) Date of Patent: Jan. 7, 2003

(54) REBAR ANCHORAGE SYSTEM FOR HORIZONTAL LIFELINE

(75) Inventors: Timothy W. Ecker, Thornton; Richard G. Reynolds, Arvada; Scott Robbins, Highlands Ranch, all of CO (US)

(73) Assignee: Rose Manufacturing Company, Englewood, CO (US)

( * ) Notice: Subject to any disclaimer, the term of this patent is extended or adjusted under 35 U.S.C. 154(b) by 0 days.

(21) Appl. No.: 09/505,542

(22) Filed: Feb. 17, 2000

(65) Prior Publication Data

US 2002/0053485 A1 May 9, 2002

(51) Int. Cl.[7] ..... A47L 3/04

(52) U.S. Cl. ..... 182/3; 182/45; 182/113; 256/32

(58) Field of Search ..... 182/3, 45, 113; 256/32, 33, 37, 35, DIG. 3; 52/405, 426; 248/237

(56) References Cited

U.S. PATENT DOCUMENTS 420,717 A * 2/1890 Cline ..... 256/32 X
507,599 A * 10/1893 Shamp ..... 256/32 X
997,725 A * 7/1911 Wilson ..... 256/32 X
1,319,887 A * 10/1919 Metzko ..... 256/32 X
2,732,182 A * 1/1956 Funk ..... 256/32 X
3,655,167 A * 4/1972 Skille ..... 256/35
4,190,234 A * 2/1980 Coleman ..... 254/83
4,366,657 A * 1/1983 Hopman ..... 52/405
5,398,777 A * 3/1995 Ouellette et al. ..... 182/3
5,699,875 A * 12/1997 Dugan ..... 182/3
5,752,860 A * 5/1998 Greaves ..... 439/781
5,815,999 A * 10/1998 Williams ..... 52/223.13
5,850,889 A * 12/1998 Rexroad et al. ..... 182/3
6,167,986 B1 * 1/2001 Calvillo ..... 182/45

* cited by examiner

*Primary Examiner*—Bruce A. Lev
(74) *Attorney, Agent, or Firm*—James G. Uber; Douglas R. Hanscom

(57) ABSTRACT

An apparatus and method for temporarily anchoring a horizontal lifeline to existing rebar extending from concrete. Preferably, two triangular frames are temporarily secured to vertically extending rebar by eight sets of J-bolts and speed nuts. The frames are preferably made of tubular steel, and may be attached to the vertically extending rebar by one workman. Two or more rebar lifeline anchors may be used in combination to secure the ends of a horizontal lifeline. Three or more anchors can be used to secure two or more lifeline that are perpendicular to each other, such as along the outer, leading edges of a construction site.

14 Claims, 5 Drawing Sheets

REBAR ANCHORAGE SYSTEM FOR HORIZONTAL LIFELINE

FIELD OF THE INVENTION

The present invention generally relates to apparatuses and methods for anchoring a horizontal lifeline and, more particularly, relates to apparatuses and methods for anchoring a horizontal lifeline to rebar.

BACKGROUND OF THE INVENTION

Reinforcing bar or "rebar" is typically used in concrete construction to reinforce a concrete structure by forming a web which is completely encased within the concrete. A raised pattern on the surface of the steel bar forms gripping surfaces around which the concrete hardens. Once the concrete hardens, shifting of the concrete is prevented by the outwardly protruding pattern on the bar.

When pouring the concrete for large elevated structures, such as sports stadiums, a horizontal lifeline may be employed to prevent workers on the leading edge, or at the forefront, of the structure under construction from falling from an elevated height and injuring themselves. A safety harness or line can be attached to the horizontal lifeline and may allow user movement in one or more directions while limiting user movement in the vertical or other direction (i.e.: prevent falling). The ends of the horizontal lifeline are typically anchored to the base of the concrete structure, or some other non-moveable object, to secure the lifeline. Previously, either no fall protection has been used or these lifelines have been secured to rebar by wrapping a cable around the vertical column. Since this method is quite variable and therefore not very reliable, let alone being subject to test, it could easily result in a system failure and user injury.

It would be desirable, therefore, to develop an apparatus and method for attaching a horizontal lifeline to rebar that did not present the disadvantages and shortcomings discussed above.

SUMMARY OF THE INVENTION

Generally, the present invention comprises an apparatus and method for anchoring a horizontal lifeline to existing rebar. Particularly, as a concrete structure is being constructed, it is often the case that vertically extending columns or rods of rebar stick up out of the previously poured section of concrete. This rebar is firmly anchored to the poured concrete, and hence, firmly anchored to the base or foundation of the structure. The apparatus of the present invention may be more easily and quickly attached and removed from the rebar than by conventional anchoring methods. Moreover, the horizontal lifeline anchoring apparatus of the present invention may be attached and removed by a single construction worker.

Preferably the anchoring apparatus of the present invention includes a pair of "L-shaped" or triangular brackets or anchor frames, oriented perpendicular to each other, that can be easily and quickly attached to the vertical rebar columns, preferably with J-bolts and speed nuts. A lifeline may then be strung from the attachment eye or connecting device that is preferably mounted on the top of the anchor frame. Two separate anchoring devices can be secured to two separate groups of extending rebar, and a lifeline can then be strung between the two anchors. A single user is thus able to more quickly and easily attach the horizontal lifeline to the vertical rebar than by conventional methods.

Other details, objects and advantages of the present invention will be more readily apparent from the following description of the presently preferred embodiments.

BRIEF DESCRIPTION OF THE DRAWINGS

The present invention and its presently preferred embodiments will be better understood by reference to the detailed disclosure hereinafter and to the accompanying drawings, wherein.

DESCRIPTION OF THE PREFERRED EMBODIMENTS

Figure 1:
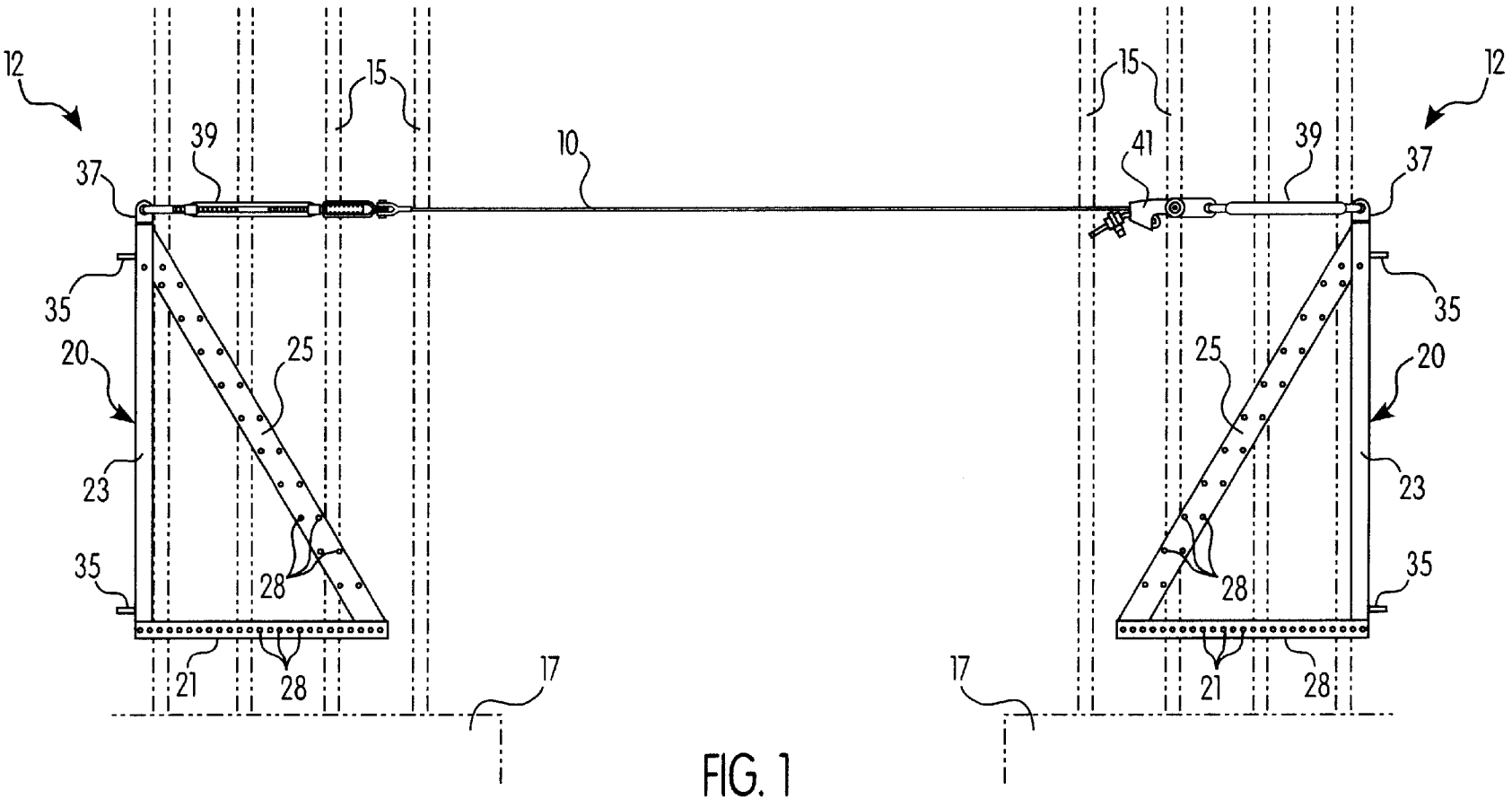
FIG. 1 is a front view of a horizontal lifeline connected between a rebar anchorage system of the present invention.

FIG. 1 generally shows a front view of one preferred embodiment of the present invention, in which two rebar lifeline anchors are used in a horizontal lifeline system. A horizontal lifeline 10 is stretched between two rebar lifeline anchors 12 that secure horizontal lifeline 10 to rebar 15 extending from the top of a concrete column 17 or other reinforced structure. Each rebar lifeline anchor 12 generally is comprised of two triangular frames or brackets 20 and 32, oriented generally perpendicular to each other (see FIG. 3), a plurality of J-bolts 27 and speed nuts 33 (see FIG. 3), and a connector or attachment eye 37 that allows a lifeline 10 to be hooked thereto.

Figure 2:
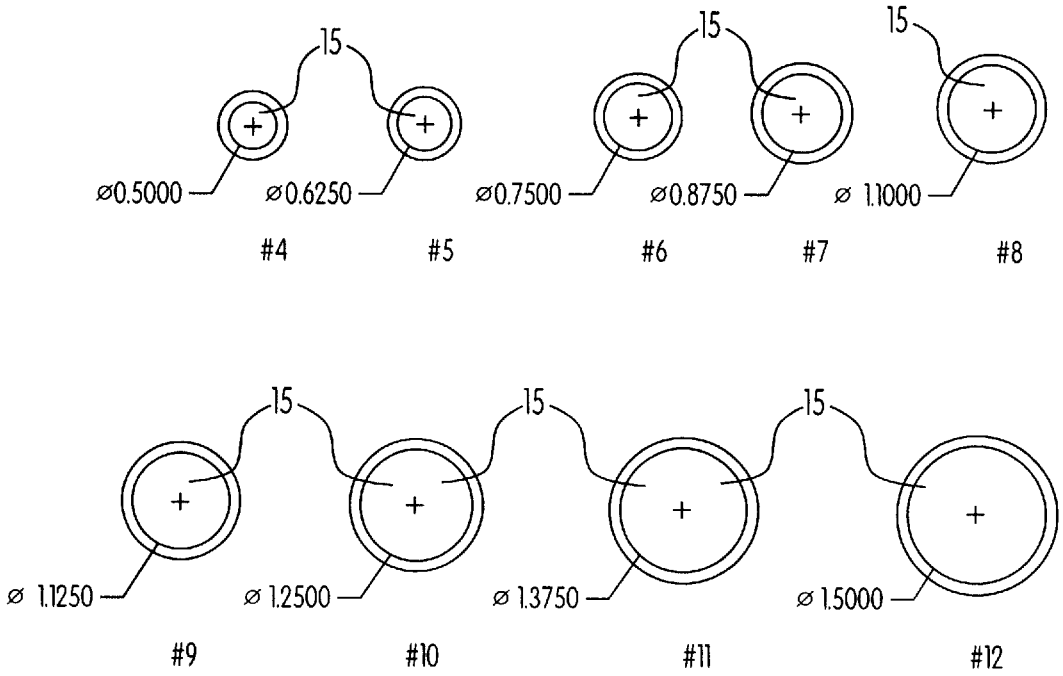
FIG. 2 shows typical diameters used for rebar.

FIG. 2 shows a conventional assortment of size diameters for rebar 15 used in making reinforced concrete structures. Typically, textured elongated rods of steel rebar 15 will be formed into a web-like arrangement to reinforce concrete poured into a frame placed over the top of rebar 15. Rebar 15 strengthens a column of poured concrete 17 (FIG. 1) and helps to prevent shifting and cracking of the concrete over time. As concrete column 17 is poured, there is typically a group of vertical rods or columns of rebar 15 extending out of the top of the previously poured column of concrete. In connection with at least one presently preferred embodiment of the present invention, it is recognized that these vertically extending rebar rods 15 can provide a convenient anchorage location from which to mount a safety line 10 (FIG. 1) for workers who need to work at dangerous heights to prepare the structure for the next section of concrete to be poured.

FIG. 1 shows the front half of two rebar lifeline anchors 12. Each rebar lifeline anchor 12 is preferably comprised of a triangular-shaped frame 20 having three members 21, 23 and 25 preferably made from hollow, square metal tubes. A base member 21 can run generally parallel to the ground, a vertical member 23 can run generally parallel to vertically extending rebar 15, and a diagonal support member 25 can connect the ends of these two members 21 and 23 together for support. Triangular frame 20 is typically made of steel and is preferably welded together into a one piece unit before being attached to the rebar 15. Frame 20 may also be made of aluminum or some other strong material. Using materials other than steel may make frame 20 lighter (allowing easier one-man mounting/dismounting) but may also increase the cost of the rebar anchorage system. It is also possible for these three frame members 21, 23 and 25 to be three separate pieces which are connected together during installation for ease of transportation of frame 20.

Figure 3:
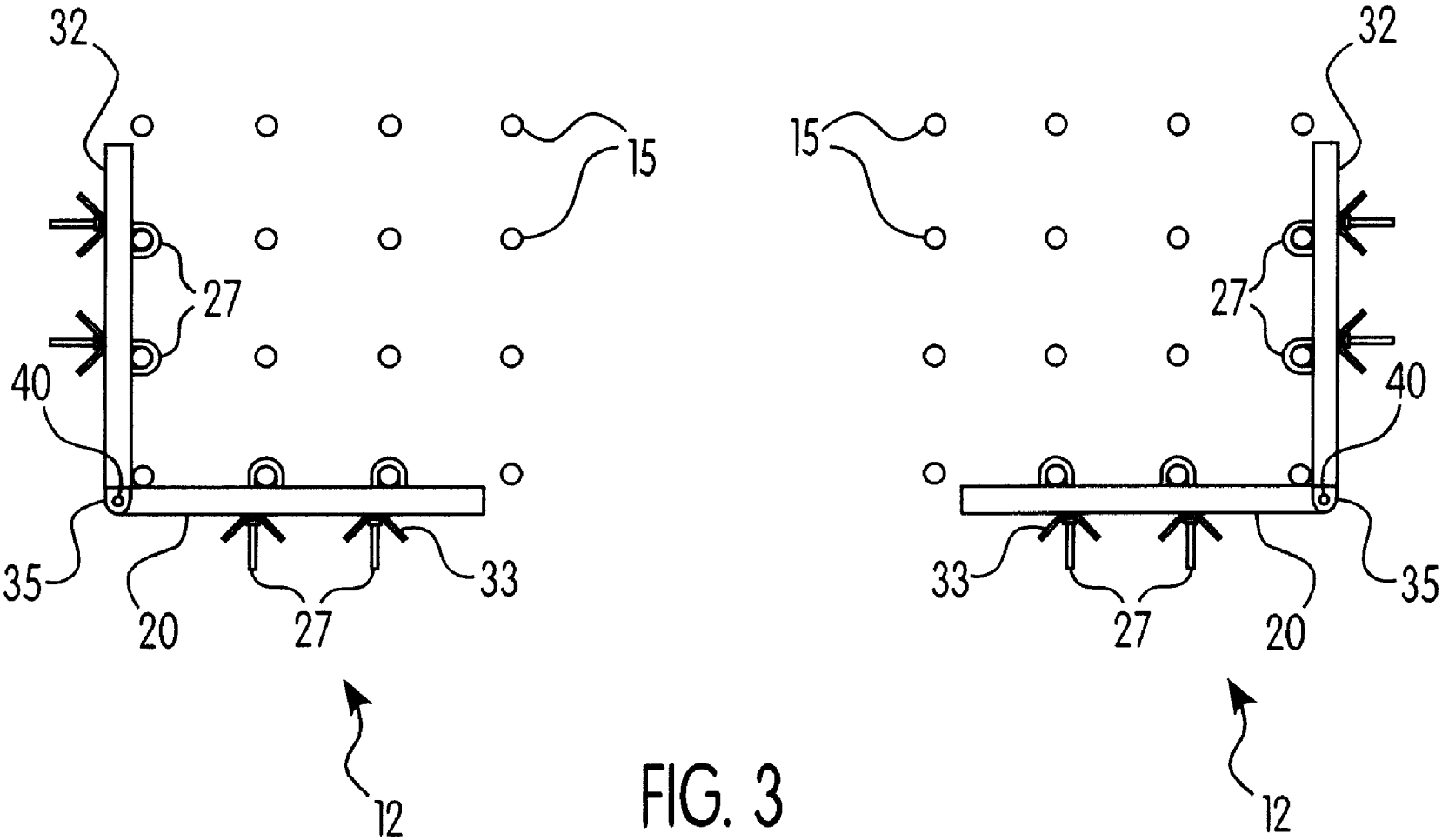
FIG. 3 is a top view of a rebar anchorage system without the horizontal lifeline and the concrete column.

FIG. 3 shows a plan view (from above) of a rebar anchorage system of the present invention without the horizontal lifeline and the concrete column. In FIG. 3, a top view of the triangular frame 20 (shown in FIG. 1 and described above) is shown oriented generally perpendicular to a second triangular frame 32 (described below). FIG. 3 shows columns or rods of rebar 15 extending vertically out of a formed concrete column (not shown). Base 21 and diagonal members 25 of a rebar triangular frame 20 may be attached to these rods of rebar 15 by J-bolts 27. Specifically, a base member 21 and diagonal member 25 are typically provided with a plurality of holes 28 drilled therethrough along the horizontal side (see FIG. 1). Frame members 21 and 25 may be held against the outside of the group of vertical rebar 15, and a plurality of J-bolts 27 may be inserted through the members 21 and 25, with the hook of the J-bolt 27 being looped around one or more vertically extending portions of rebar 15 (see FIG. 3).

Figure 4:
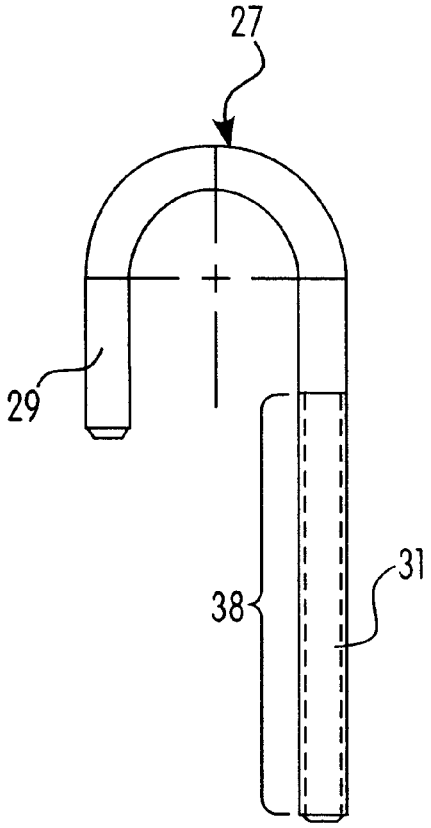
FIG. 4 shows a J-bolt that can be used with a rebar anchorage system of the present invention.
Figure 5A:
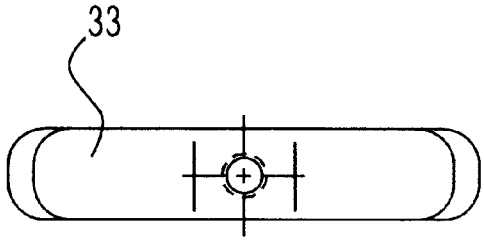
FIGS. 5A (top view) and 5B (front view) show a speed nut used with a rebar anchorage system of the present invention.
Figure 5B:
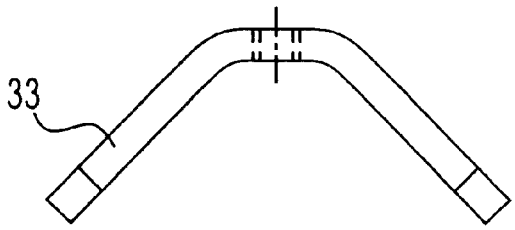

A J-bolt 27 for use with the present invention is shown in FIG. 4, but any number of similar attachment devices, as would be obvious to one skilled in the art, such as a flexible coupling, could be substituted for J-bolt 27 while still being within the scope of the present invention. The shorter end 29 of the J-bolt 27 is inserted into one of the holes 28 drilled through the base member 21 and diagonal member 25 of the frame 20 (and frame 32 described below) and extends into the middle of these hollow members. The longer end 31 of the J-bolt 27 is preferably threaded over a length 38 and is inserted all the way through both walls of the members 21 and 25. The longer threaded end 31 typically protrudes outside the wall of the members 21 and 25 of the frame 20. A speed nut 33 is then preferably threaded onto the threaded end 31 of the J-bolt 27 and tightened to secure the frame 20 to one or more vertically extending rebar rods 15. A typical example of such a speed nut 33 is depicted in FIG. 5 with detailed top (5A) and front (5B) views.

A plurality of J-bolts 27 and speed nuts 33 can be used in tandem, as shown in FIG. 3, to secure the frame 20 to rebar columns 15. Typically, four J-bolts 27 and speed nuts 33 (two for the base member 21 and two for the diagonal member 25) are used in a preferred embodiment of the present invention. Once the speed nuts 33 are tightened, the frame 20 resists sliding up or down the rebar 15, and is thereby securely fixed with respect to the concrete 17. The J-bolt 27 and speed nut 33 combination allows a single worker to securely attach one or more anchor frames 20 to rebar 15.

As briefly mentioned above, preferably, a second frame 32 is attached to vertical rebar 15 adjacent to the first frame 20. As seen in FIG. 3, this second frame 32 may preferably be attached perpendicular to first frame 20. Although two separate reference numbers are shown for clarity, these two frames 20 and 32 may be identical in actual practice. This second frame 32 is preferably attached to the vertically extending rebar 15 in the same way as first frame 20. Again, four J-bolts 27 used with four speed nuts 33 are sufficient for stability.

Although the frames 20 and 32 have been described above with respect to hollow, square tubes 21, 23 and 25 attached to rebar 15 with a plurality of J-bolts 27 and speed nuts 33, one may replace one or more of these parts with alternate parts that function similarly. For example, one may use rods, hollow rods or angular bars instead of hollow bars. Similarly, one may use a square frame or other shaped frame instead of the triangular frame described herein.

Returning to FIG. 1, there are two frame connection tabs 35 that extend outward from the frame 20, with a hole or slot extending therethrough in the vertical direction. These frame connection tabs 35 can be simple planar pieces of metal that are welded to vertical member 23 of the frame 20 (and the second frame 32). When viewed from above (see FIG. 3), a slot or hole extends therethrough. These frame connection tabs 35 are constructed so that when frames 20 and 32 are both attached to the vertically extending rebar 15, and vertical members 23 of the frames 20 and 32 are oriented adjacent to each other, the two respective pairs of slots or holes through the frame connection tabs 35 line up vertically. Therefore, a pin 40 (see FIG. 3) can be inserted through the holes in frame connection tabs 35 to connect the two frames 20 and 32 together. In this way, frames 20 and 32 may be attached not only to the vertical rebar 15, but also to each other, which increases the strength of rebar anchor 12 as a whole.

At the top of vertical member 23 of frame 20 (and frame 32) is a connector such as attachment loop 37 that allows a horizontal lifeline 10 or other safety device to be attached to frame 20 and, therefore, to the vertical rebar 15. A horizontal lifeline 10 can be attached to eye 37, and the lifeline 10 may be pulled in a variety of directions while remaining anchored to vertical rebar 15 through the rebar anchor 12.

The above discussion detailed the structure and attachment methods of one embodiment of a rebar anchorage system of the present invention. Preferably two rebar lifeline anchors 12 are used with a horizontal lifeline system, with one at each end of the lifeline. FIG. 1 shows two rebar lifeline anchors 12 as used in a presently preferred embodiment of a present invention. To aid in clarity, the second frame 32 is not shown. The two anchors 12 are mounted on adjacent or parallel groups of rebar 15, with the lifeline connectors, in this case loops 37, lining up in the same plane. In this example, a horizontal lifeline 10, such as the Horizon™ Horizontal Lifeline manufactured by the Rose Manufacturing Company, is connected between the two rebar anchors 12. Generally, the ends of horizontal lifeline 10 are attached to loops 37 by way of a wedge socket on the free end 41, with lifeline 10 having some small amount of slack. Then, lifeline 10 is tightened by way of a turnbuckle 39 at the jaw end or according to some conventional practice. The result is a horizontal lifeline cable 10 that is firmly attached to at least two sets of vertical rebar 15 extending from the top of a concrete column 17.

The present rebar anchorage system may be more easily and more quickly attached to rebar 15 than by conventional methods and apparatuses. A single worker can attach, detach or adjust the anchorage of horizontal lifeline 10 with a decreased amount of effort in a decreased amount of time compared to conventional methods and devices.

In another embodiment, if one end of horizontal lifeline 10 is secured to the building foundation by some other arrangement, such as for example to an I-beam by means of a clamp such as the Versatile BeamGrip manufactured by the Rose Manufacturing Company, the present invention can be used with only one rebar lifeline anchor 12. Such a method can be used in a system where one end of lifeline 10 remains fixed while the other end of lifeline 10 may be moved. The fixed end of lifeline 10 may be mounted to the building foundation while the moveable end of lifeline 10 may be mounted to various vertically extending rebar 15 as the construction proceeds.

In another preferred embodiment of the present invention, a third rebar lifeline anchor 12 may be attached to a third group of vertically extending rebar 15. A second horizontal lifeline 10 may then be strung between the third anchor 12 and one of the first two anchors 12. Preferably, this second horizontal lifeline 10 is strung perpendicular to the first horizontal lifeline 10. Because each anchor 12 is secured to rebar 15 by two substantially perpendicular frames 20 and 32, one anchor 12 is capable of supporting more than one horizontal lifeline 10 at the same time. The user merely has to connect one end of each horizontal lifeline 10 to each of loops 37 at the top of frames 20 and 32.

Figure 6:
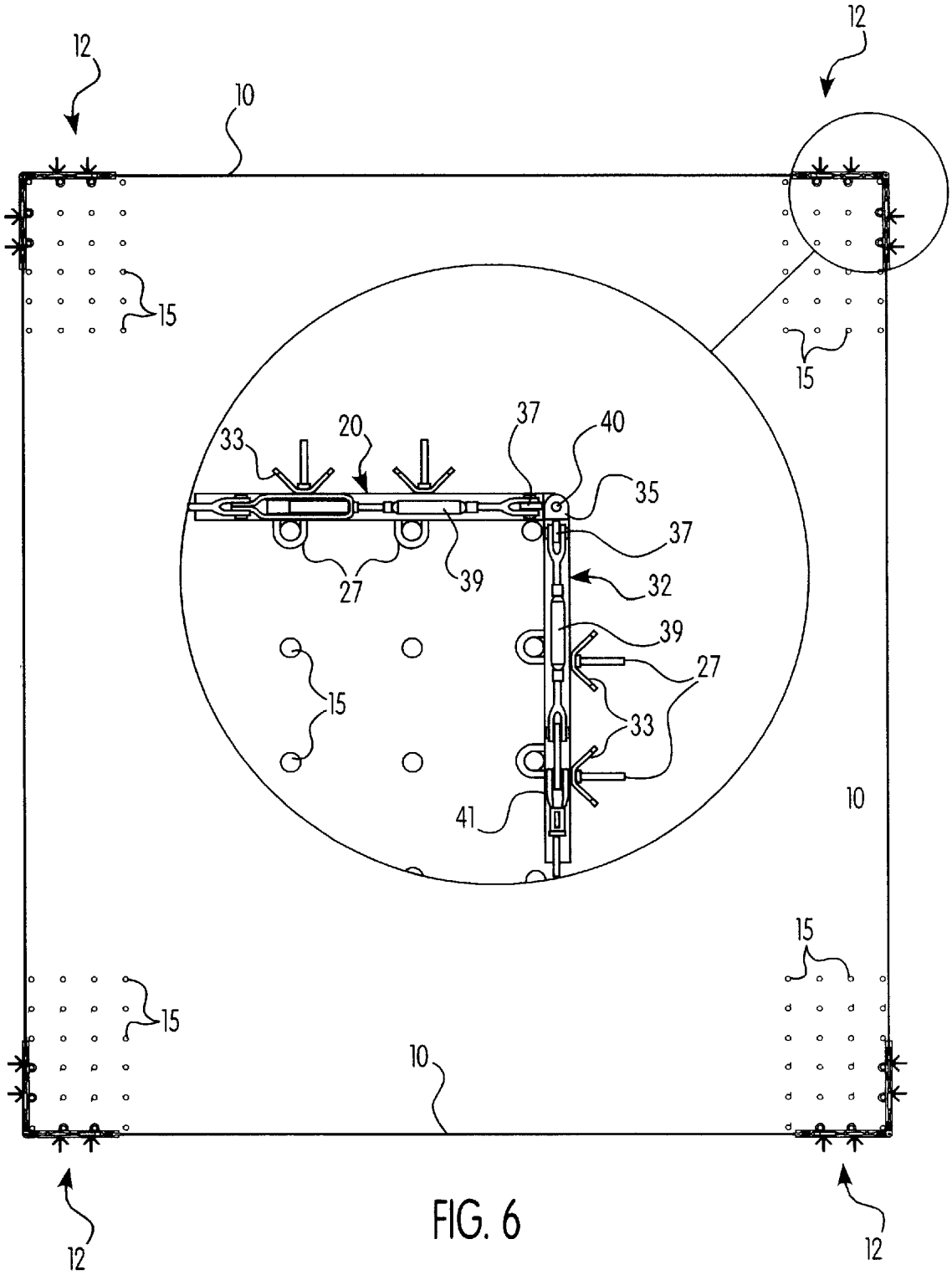
FIG. 6 shows four rebar anchors attached to four groups of rebar with an exploded view of one rebar anchor with two lifelines attached thereto.

For example, FIG. 6 shows four rebar lifeline anchors 12 attached to four groups of vertical rebar 12. Preferably, there are three lifelines 10 attached between the four rebar lifeline anchors 12. FIG. 6 shows the three lifelines 10 oriented generally perpendicular to each other and forming a safety system that runs along the outside of the vertically extending rebar 15. The exploded view in the center of FIG. 6 details the connections at the top of rebar lifeline anchor 12. Two loops 37 are attached to the top of frames 20 and 32 respectively. Because the frames 20 and 32 are oriented generally perpendicular with respect to each other, the loops 37 are likewise oriented generally perpendicular to each other. Therefore, two lifelines 10 can be connected to a single rebar lifeline anchor 12 perpendicular to each other. In this way, four rebar lifeline anchors 12 can be used to connect three or more lifelines 10 generally around the outside of four or more groups of extending rebar 15 (as in FIG. 6).

Also, more than one horizontal lifeline 10 may be strung parallel to each other from two or more rebar lifeline anchors 12. Additional lifelines 10 may be strung for further safety support, or, for example, one lifeline 10 may extend further than another lifeline, allowing different users a greater or lesser amount of mobility depending on the intended application and safety requirements.

When horizontal lifeline 10 needs to be shifted, moved, or disassembled, a reverse process is employed. Horizontal lifelines 10 are disconnected, speed nuts 33 or other attachment devices are loosened, J-bolts 27 are removed, and frames 20 and 32 are removed. Frame 20 is then ready to be remounted in a different location.

Rebar lifeline anchors 12 according to the present invention may also be adjustable so that one or more anchors 12 can be moved without completely disassembling the entire horizontal lifeline system. In one presently preferred method, speed nuts 33 can merely be loosened, rather than removed, so that the J-bolt 27 and speed nut 33 combinations remain attached to frames 20 and 32. Frames 20 and 32 can then be slid up or down the vertical rebar, or can be moved to an entirely new location. Once in a new location, speed nuts 33 can again be tightened, pulling the J-bolts 27 securely against the vertically extending rebar 15. In this way, a reduced amount of time and effort can be expended to relocate or adjust the rebar anchorage system of the present invention.

Although the invention has been described with respect to attaching a horizontal lifeline onto vertically extending columns or rods of rebar, the present invention can also be used with other directional orientations. Because the anchor frames are fixedly attached to the rebar (not relying on gravity) a horizontal or otherwise oriented lifeline may be attached to rebar or other rods, textured or otherwise, that extend in any direction from concrete or some other material. Any orientations presented in the preceding disclosure were by way of example only and should not be construed to limit the present invention in any way.

Although the invention has been described above in terms of particular embodiments, one of ordinary skill in the art, in light of the teachings herein, can generate additional embodiments and modifications without departing from the spirit of, or exceeding the scope of, the claimed invention. Accordingly, it is to be understood that the drawings and the descriptions herein are proffered by way of example only to facilitate comprehension of the invention and should not be construed to limit the scope thereof.

What is claimed is:

1. A temporary lifeline anchorage system comprising:

exposed rebar members set in and extending from poured concrete in a structure under construction;

a lifeline;

at least one frame, the frame being attachable to, and removable from the exposed rebar members set in and extending from the poured concrete in a structure under construction;

connectors attached to the frame and engageable with the exposed rebar members during the temporary attachment of the frame to the exposed rebar members; and a lifeline attachment on the frame, the lifeline being attached to the lifeline attachment.

2. The temporary lifeline anchorage system of claim 1, wherein the connectors are a plurality of J-bolts and associated speed nuts.

3. The temporary lifeline anchorage system of claim 2, wherein the plurality of J-bolts and associated speed nuts can be loosened to allow movement of the frame on the extending rebar.

4. The temporary lifeline anchorage system of claim 1, further including a second frame and wherein the one frame is adapted to accommodate a first end of the lifeline and the second frame is adapted to accommodate a second end of the lifeline.

5. The temporary lifeline anchorage system of claim 4, further including a second lifeline, a third frame adapted to accommodate a first end of the second lifeline, and wherein the second frame is adapted to accommodate a second end of the second lifeline.

6. The temporary lifeline anchorage system of claim 1 wherein the at least one frame is triangular.

7. The temporary lifeline anchorage system of claim 6 wherein the triangular frame includes a plurality of holes, and further wherein the connectors are a plurality of J-bolts and speed nuts, the J-bolts being inserted in the holes to attach the triangular frame to the extending rebar with the speed nuts.

8. The temporary lifeline anchorage system of claim 1 wherein the at least one frame includes first and second triangular frames oriented generally perpendicularly with respect to each other.

9. The temporary lifeline anchorage system of claim 8 wherein the first and second triangular frames are attached to each other.

10. The temporary lifeline anchorage system of claim 8 wherein the first and second triangular frames each include a plurality of holes and further wherein the connectors are a plurality of J-bolts and speed nuts, the J-bolts being inserted in the holes to attach the first and second triangular frames to the extending rebar with the speed nuts.

11. A method for temporarily attaching a lifeline to a structure including:

locating exposed rebar extending from concrete in the structure;

providing a frame;

providing connectors for removably attaching the frame to the exposed rebar extending from concrete;

securing the frame to the exposed extending rebar using the connectors;

providing a lifeline attachment on the frame;

providing a lifeline; and attaching a first end of the lifeline to the lifeline attachment on the frame.

12. The method of claim 11 further including providing a second frame;

locating the second frame remote from the frame;

securing the second frame to the exposed extending rebar; and attaching a second end of the lifeline to the second frame.

13. The method of claim 12 further including providing the connectors as a plurality of J-bolts and a plurality of speed nuts.

14. The method of claim 13, further including loosening the J-bolts and speed nuts to permit movement of the frame and the second frame along the exposed extending rebar.

* * * * *